United States Patent [19]

Bennett et al.

[11] 3,965,512

[45] June 29, 1976

[54] PRECISE NAVIGATION BUOY

[75] Inventors: Derek J. Bennett, Thousand Oaks; Leslie G. Bullen, Westlake Village, both of Calif.

[73] Assignee: Bunker Ramo Corporation, Oak Brook, Ill.

[22] Filed: Feb. 10, 1975

[21] Appl. No.: 548,552

[52] U.S. Cl. ..... 9/8 R

[51] Int. Cl.[2] ..... B63B 21/52

[58] Field of Search ..... 9/8 R; 114/206 R, 230

[56] References Cited

UNITED STATES PATENTS

| | | | |
|---|---|---|---|
| 2,801,429 | 8/1957 | Semon | 9/8 R |
| 3,005,215 | 10/1961 | Colt | 9/8 R |
| 3,056,978 | 10/1962 | Bradley | 9/9 |
| 3,372,665 | 3/1968 | Mesler | 9/8 R |
| 3,471,877 | 10/1969 | Bayles | 9/8 R |

*Primary Examiner*—Duane A. Reger
*Assistant Examiner*—Gregory W. O'Connor
*Attorney, Agent, or Firm*—T. Devine; F. M. Arbuckle

[57] ABSTRACT

A prolate spheroid shaped buoy is resiliently moored to an anchor by means of a cable wound on a reel in the anchor with the reel latched to power springs coaxially wound upon a shaft extending through the reel. The springs are pretensed on the shaft, prior to deployment, and the shaft is latched against rotation by a pair of spring biased pins engaging a plunger. The reel may thus rotate freely under control of a brake as the anchor falls from the buoy during deployment. The plunger is operated automatically when the anchor falls to the ocean bottom to release the pins in sequence with one pin engaging the cable reel before the other pin releases the shaft to ensure that the springs are latched to the buoy and cable to resiliently moor the same. A plate on the plunger arm closes the bottom wall of the anchor to prevent the ingress of contaminants.

15 Claims, 14 Drawing Figures

FIG. 2
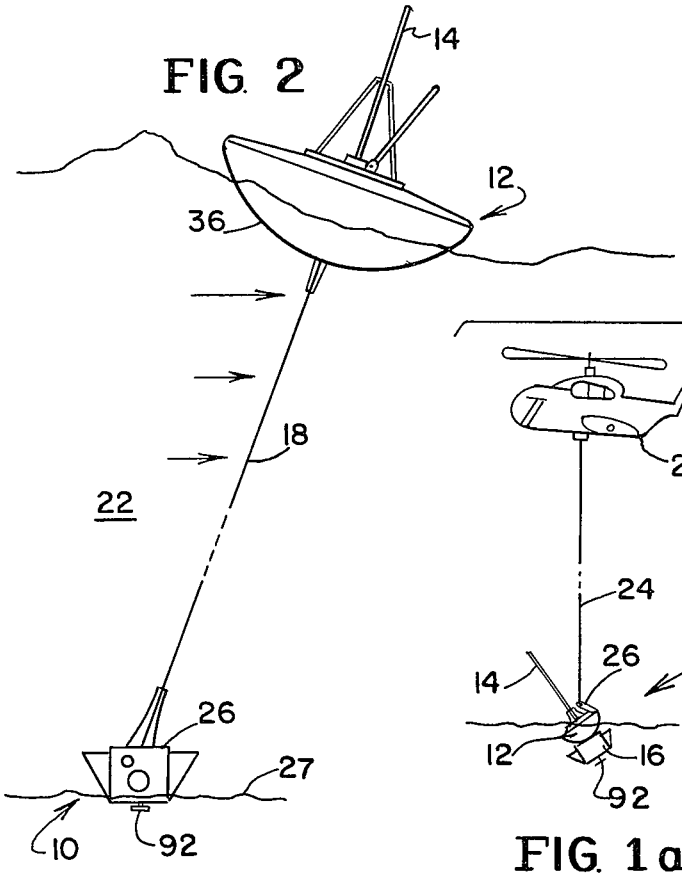
FIG. 1
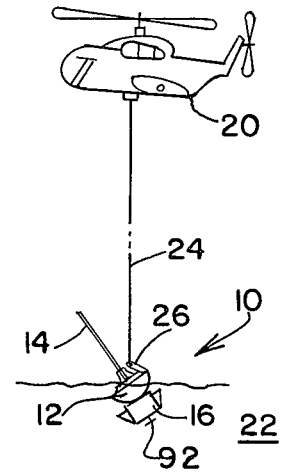
FIG. 1a
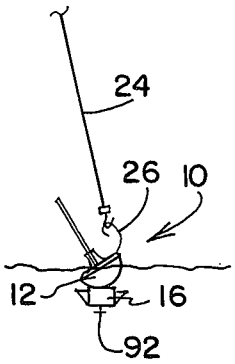
FIG. 1b
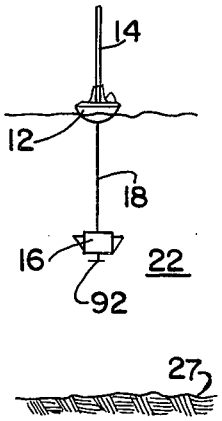
FIG. 1c
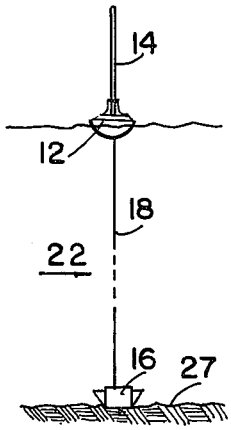
FIG. 1d

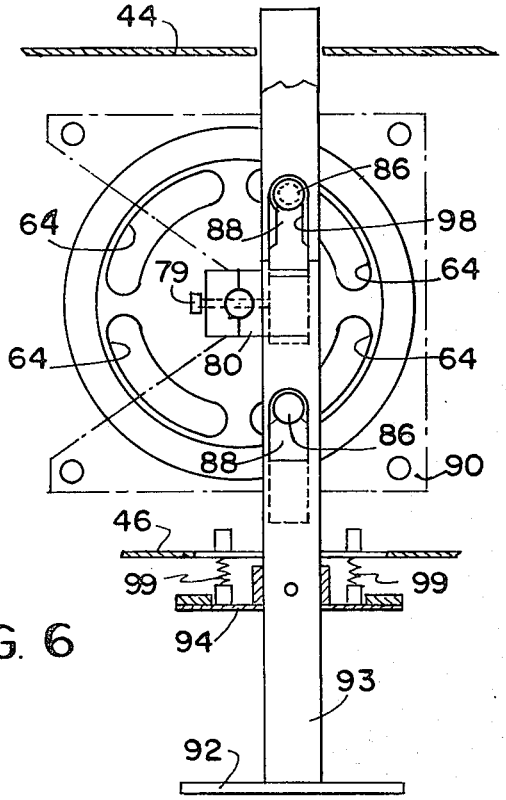
FIG. 6
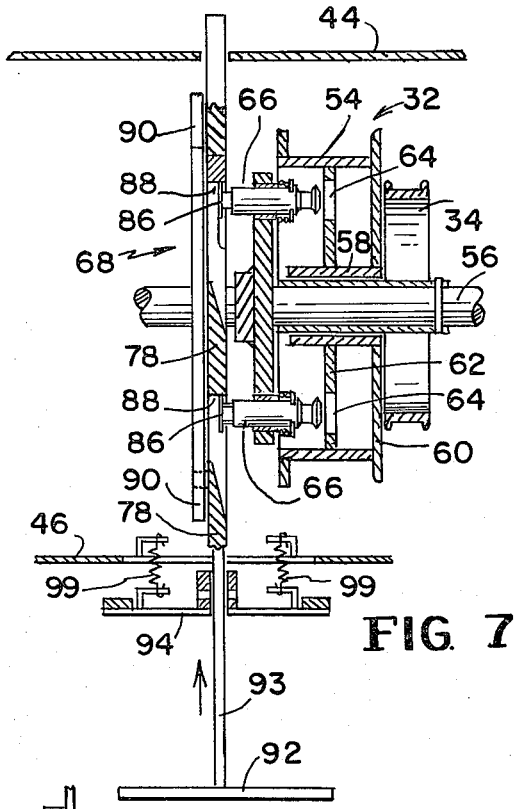
FIG. 7
FIG. 9
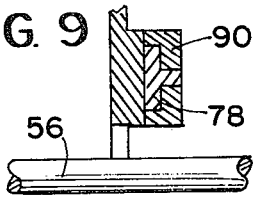
FIG. 8
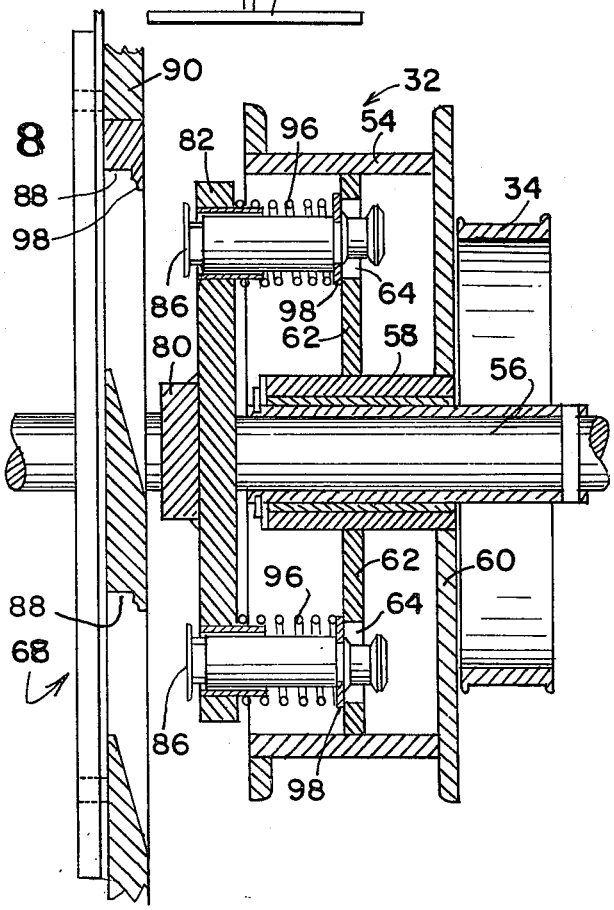
FIG. 10
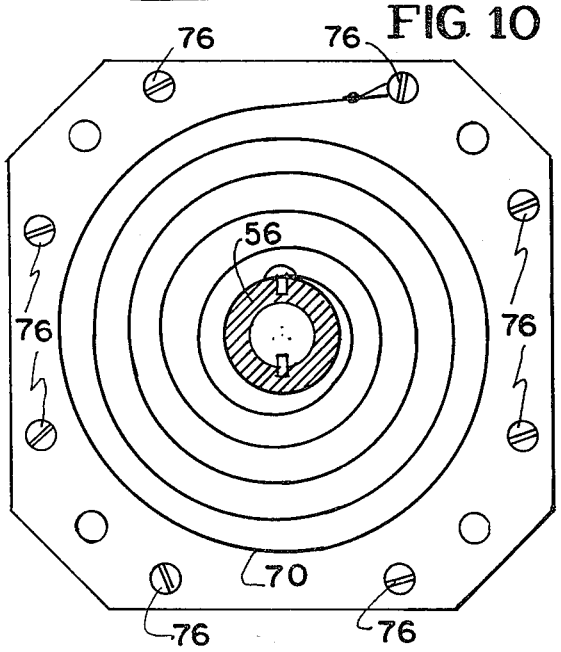

PRECISE NAVIGATION BUOY

FIELD OF THE INVENTION

This invention relates in general to an improved buoy and anchor assembly and more particularly, to an improved arrangement or apparatus for resiliently mooring a buoy to an anchor.

SUMMARY OF THE PRIOR ART

Buoys used for fixed or relatively fixed reference positions in oceans or coastal waters, for example, are often deposited with the anchor assembled thereto on the water. The anchor and buoy are then separated and the buoy having a recording and/or signal transmitting equipment remains at the water surface moored or tethered by means of a cable to the anchor which drops to the ocean bottom.

Mooring the buoy to the anchor fixes the buoy position unless the forces on the buoy are large enough to displace the anchor, and to prevent this condition from occurring, the cable may be placed under spring tension which limits the displacement of the buoy in response to normal ambient forces thereon. Alternatively, a motor may be provided for controlling the length of cable between the anchor and buoy, but this requires the addition of a source of power and has a large number of drawbacks.

An example of an arrangement for resiliently mooring the buoy to the anchor is shown in U.S. Pat. No. 3,005,215. In that patent the cable is wound on a reel or drum located in the buoy. The buoy and anchor drop as a unit through the water, when deposited, until a pressure responsive device separates the buoy from the anchor. The buoy then ascends in the water and when it reaches a predetermined depth, a pressure responsive device connects or latches so-called negator springs to the cable reel for resiliently resisting the forces of wind, tide, waves and current, for example, tending to move the buoy from its position relative to the anchor.

The mounting of the cable and its reel together with the negator springs in the buoy, of course, add to the buoy weight. A large buoy is therefore required to compensate for the weight and it is subject to large hydrodynamic forces. The negator springs provide a low torque with a long stroke and each requires a winding drum and an unwinding drum with the springs winding in reverse direction on each drum so that they are subject to fatigue and have a relatively short life.

Additionally, if the springs are wound by the relative movement between the buoy and anchor when they separate, the tension or force stored in the spring is relatively indeterminate.

SUMMARY OF THE INVENTION

In the present invention, the aforementioned problems are substantially reduced by mounting the cable, its reel and springs in the anchor thereby reducing the need for additional weight in the anchor and permitting the use of a smaller light weight relatively inexpensive buoy, easily separated on deployment.

Instead of so-called negator springs, the present invention utilizes power springs, which are prewound in a spiral coaxially with the cable reel to provide a predetermined or known force and are disconnected from the cable during the deployment. These springs require only one shaft and provide a relatively constant high torque or power output with a limited stroke over the normal range of buoy movement and have a relatively long life. The buoy and anchor are therefore easily separated at the water surface by conventional means on deployment and the anchor simply falls to the water floor.

To latch the power springs to the cable reel, a single impact rod and reel engagement or plunger assembly is operated when the anchor approaches the ocean floor to connect the tensed power springs to the cable reel so that operation takes place automatically at the proper depth and is independent of the exact distance between the ocean floor and the surface.

The power springs are tensed about the aforementioned shaft prior to deployment of the buoy and anchor, as mentioned, and the shaft and springs are connected to a plunger arm by means of a pair of spring biased pins so that the plunger arm holds the shaft against rotation and loss of spring power. The anchor and buoy are conventionally separated on deposit in the water and as the anchor descends, the cable is freely paid off from its reel. A brake prevents overrunning of the reel during descent of the anchor. When the anchor approaches the ocean bottom or floor, the plunger arm engages the floor and is moved transversely of the shaft axis to sequentially disengage the pins. The pins now move parallel to the shaft axis to engage the cable reel and latch the shaft and power springs to the reel for placing the cable under resilient tension. The sequential release of the pins is provided to ensure that one pin engages the cable reel before the other pin releases the power springs and shaft from the plunger arm.

A pair of sheaves enable the cable to be paid out or retracted without fraying, twisting or binding as the buoy rotates or precesses about its anchor position in response to the various forces acting thereon, while the buoy is provided with a prolate spheroid shape for stability and to avoid unnecessary drag under normal conditions.

The following description, together with the accompanying drawings and claims, will provide a more detailed understanding of the present invention.

BRIEF DESCRIPTION OF THE DRAWINGS

FIGS. 1*a* and 1*b*, 1*c* and 1*d* are a sequence of diagrammatic illustrations indicating the manner in which the buoy and anchor assembly are deployed and the anchor descends to the ocean floor.

FIG. 2 illustrates one manner in which the buoy reacts to water current or wave motion.

FIG. 6 is a front elevational view partially in section of the impact rod and reel engagement assembly for connecting the power springs to the cable reel.

FIG. 7 is a partial sectional view showing the impact rod and reel engagement assembly disengaged from the cable reel.

FIG. 8 is an enlarged sectional view illustrating the reel engagement assembly in its operated condition; and FIG. 9 is a sectional view of the plunger arm in its guidance; and FIG. 10 is a generally schematic view illustrating the power spring winding.

DESCRIPTION OF THE PREFERRED EMBODIMENT

Figure 3:
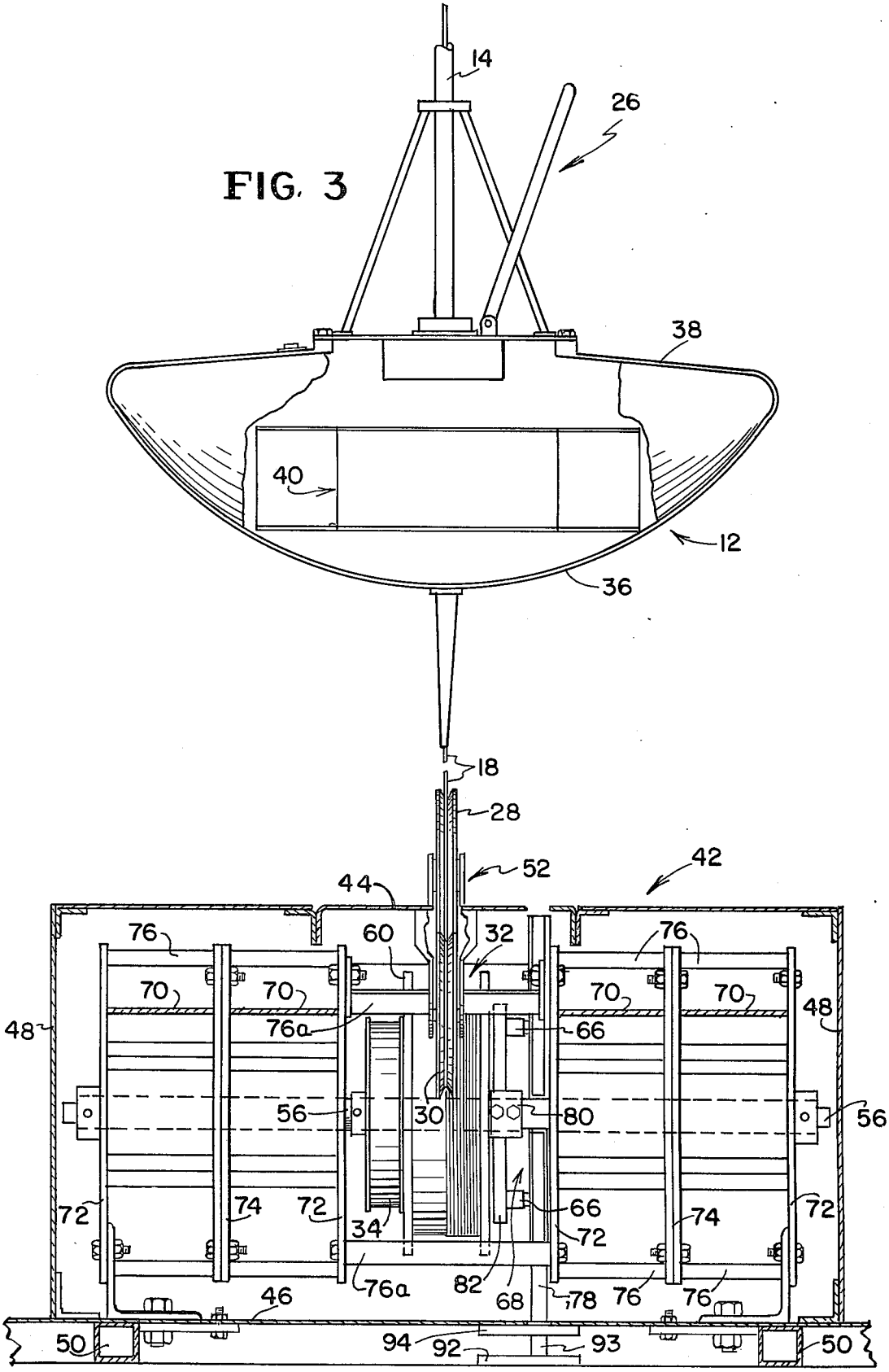
FIG. 3 is a view illustrating the buoy and anchor assembly with the housing of the anchor broken away to illustrate the reel and spring assembly.

In FIGS. 1 and 2, a buoy and anchor assembly is indicated by the reference character 10. The assembly 10 includes a buoy 12, which carries an antenna 14 for radio or other electro-magnetic wave transmission or reception and the buoy is tethered or moored to an anchor 16 by means of a cable 18.

The assembly 10 is deposited or deployed by means of a ship or helicopter 20 in the water 22 at a desired location. This location may be in ocean coastal waters or other similar navigable waters and the radio equipment is designed to transmit information concerning navigation, meteorological and/or other water conditions while the buoy provides a visible channel marking, for example. The helicopter or ship may deposit the buoy 12 and anchor 16 on the ocean or water surface by means of a cable or drop rope assembly 24, for example, as illustrated in FIGS. 1a and 1b. The buoy and anchor are supported from the drop rope assembly 24 by means of a bridle or other conventional means, which are disengaged on deposit of the buoy and anchor assembly, and the rope assembly 24 then controls a suitable lanyard assembly indicated at 26 for separating the anchor 16 from the buoy 12.

Figure 4:
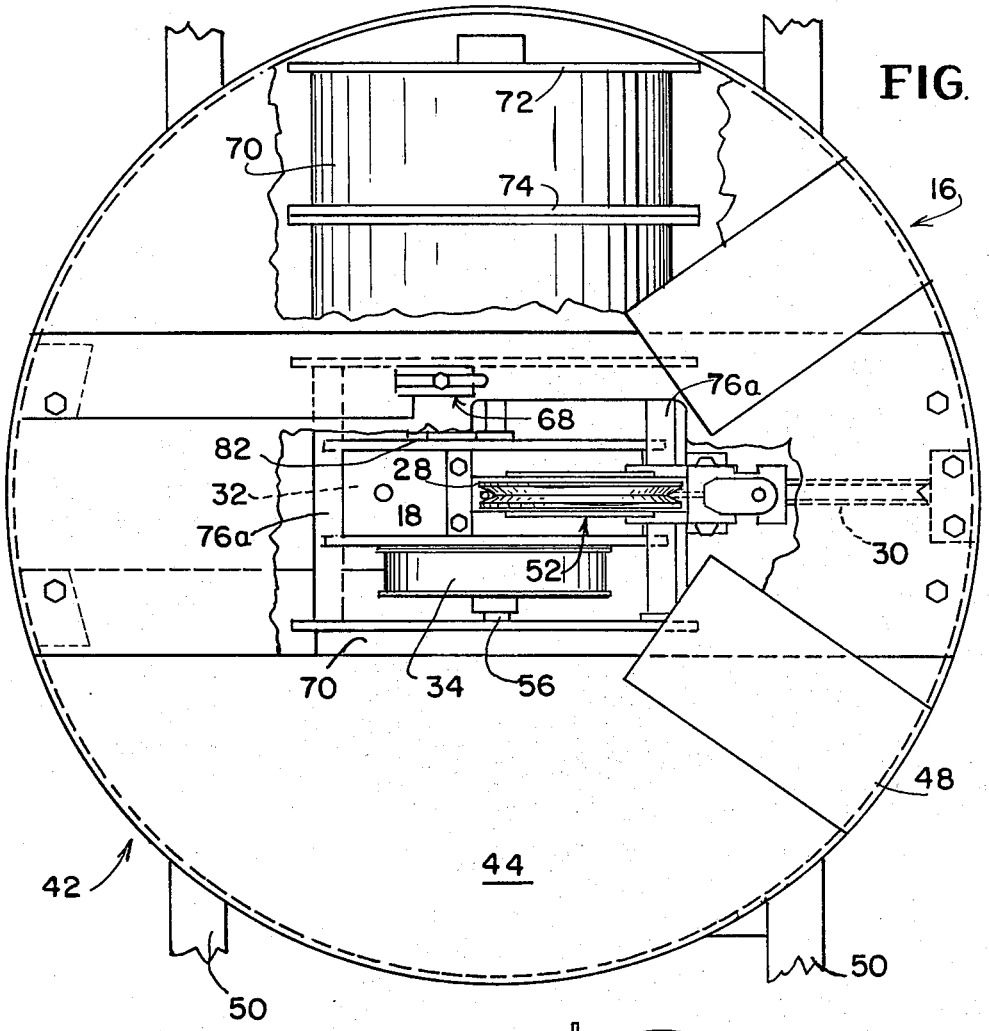
FIG. 4 is a top elevational view of the anchor with the housing partially broken away.
Figure 5:
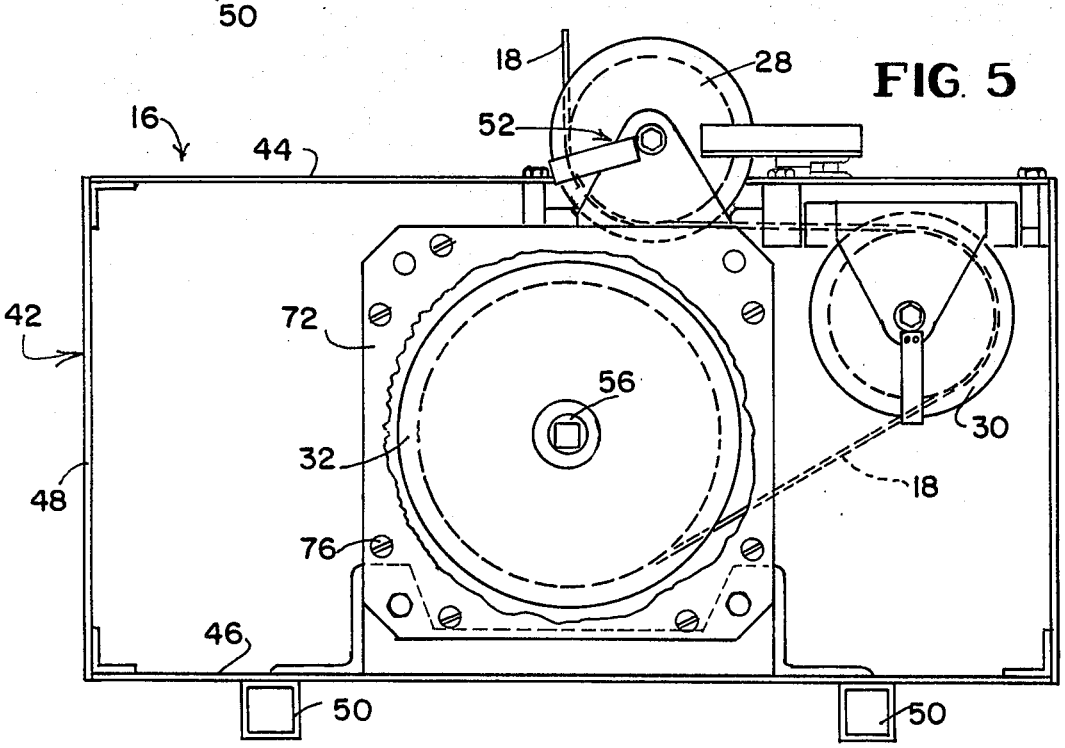
FIG. 5 is a side elevational view of the anchor with the housing broken away to illustrate the cable path.

The anchor 16 on separating from the buoy 12, initiates its descent through the water 22 toward the water floor 27, while the buoy 12 remains at the water surface as seen in FIG. 1*c*. The cable 18 is secured at one end to the buoy 10 and passes about a pair of tandemly arranged sheaves 28 and 30 seen in FIGS. 3, 4 and 5 and is paid off or unwound from a reel or drum 32 located in the anchor. As the anchor 16 descends, the cable 18 is freely unwound from the drum 32, under some tension provided by a conventional brake assembly 34 to prevent overrunning of the drum and excess slack in the cable 18.

The buoy 12 includes a shell or housing having a prolate spherically shaped bottom surface 36 to provide stability and minimize water drag and a platform-like upper surface 38 from which the antenna 14 projects. The buoy 12 houses or includes suitable radio transmitting and/or receiving equipment together with appropriate power supplies and control equipment indicated generally at 40.

The anchor 16 includes a housing 42 having top, bottom and side walls 44, 46 and 48 with beams and channels 50 serving to reinforce the bottom wall 46. The side wall 44 is generally annular as may be seen in FIG. 4 and suitable reinforcing may be provided for top wall 44 together with stabilizing fins for the housing. The top wall 44 rotatably supports the fairlead sheave 28 above the wall by means of a bearing assembly 52 and the sheave 30 supported below the wall 44 for rotation about a fixed axis at a position offset from the surface of the drum 32 and parallel with the drum to lead the cable 18 from the drum without danger of fraying, twisting or binding.

The drum 32 includes a hub portion 54 as best seen in FIGS. 7 and 8 spaced radially outwardly of a shaft 56 and journalled on the shaft by means of a bearing sleeve 58 secured to hub portion 54 by a radial end wall, flange or disc 60 and a second radial wall, flange or disc 62 located intermediate opposite axial ends of the hub portion 54 and sleeve 58.

The flange 62 is provided with a series of four circumferentially spaced arcuate slots, cutouts or passageways 64 each extending over an equal angular distance as seen best in FIG. 6 for the purpose of receiving a respective one of a pair of engagement or cable lockup pins 66. The lockup pins 66 form a portion of an impact rod and reel engagement or plunger assembly 68 that serves to latch or engage tensed power springs 70 with the drum 32 automatically in response to the anchor descending to the ocean bottom as will be explained.

A pair of power springs 70 are spaced on each axial side of the drum 32 and the springs are located between respective spaced end plates 72 and intermediate plates 74, which support suitable means for journalling the shaft 56. Spacing bars, such as 76 and 76a are provided between the plates 72 and also for spacing the plates 72 on opposite sides of drum 32 to provide a solid or rigid support structure.

The springs 70 are spirally wound so-called spirator springs, which are of a type such as shown in Bulletin NS-1-1, Copyright 1971, by Ametek, Inc. and sold by the Hunter Spring Division, One Spring Avenue, Hatfield, Pa. and the California Spring Division, 8401 Slauson Avenue, Pico Rivera, California. The spirator springs offer advantages over conventional negator springs in that a constant force or torque is provided in a stroke over the desired range of buoy movement without the need for an additional windup shaft and without requiring reverse bending such as occurs in negator springs.

Therefore, each spring 70 is wound in a spiral as illustrated in FIG. 10, secured at its inner radial or one end by a fastener or in a respective slot in shaft 56 and the other or radial outward end of the spring is secured to a fixed support such as provided by one or more of the spacing bars 76, for example.

The springs 70 are initially provided with the desired tension by rotating the shaft 56 to a selected position and securing the shaft 56 to a non-rotatable plunger or plunger arm 78. The shaft 56 is secured to plunger arm 78 by a pin 79 or the like, extending through the shaft 56 into radial arm 80 which has a cross leg 82. Passageways 84 are formed in leg 82 and each receives a cable lockup pin located for engagement with arm 78 as seen in FIG. 7.

The cable lockup pins 66 are radially offset from the shaft 56 and each extends axially of shaft 56 with each pin having a radially enlarged end flange 86 engaged against a wall of a respective recess 88 in an anchor impact rod or plunger arm 78. The wall of each recess 88 actually engages in a recess in the periphery of the respective pin adjacent the end flange so that movement of the pin in either axial direction is then prevented. The plunger arm 78 rides in a guideway 90 as best seen in FIG. 9 secured against movement to an adjacent side plate 72 so that the arm 78 is secured against rotational movement about the axis of shaft 56 and latches the shaft 56 to restrain the shaft 56 against rotation and maintain the power springs 70 tensed.

The arm 78 projects or extends through an opening in the bottom wall 46 of the anchor 16 as seen in FIGS. 6 and 7 and carries a bottom impact plate 92 at the projecting end 93 and a flooding port closure plate 94. Thus, the plunger arm has means for closing the opening in the bottom wall in response to the means or impact plate 92 engaging the ocean bottom or water floor and moving arm 78 upwardly and transverse to the axis of shaft 56.

The end flange 86 of each engagement pin 66 is biased against the adjacent wall of the respective recess 88 by a respective coaxial coil or helical spring 96. Each spring 96 is engaged between one face of the cross leg 82 and a flange 98 adjacent the other end of each pin to bias the respective pin 66 in one direction axially of shaft 56 toward the central flange or wall 62.

With the described arrangement of the springs 70 and the drum 32, the center of gravity of the anchor is below the central horizontal axis of the anchor 16 so that when released from the buoy 12 and during the descent from the buoy, the bottom wall 46 of the anchor remains oriented toward the ocean bottom.

As the anchor 16 approaches the ocean bottom, the anchor impact plate 92 engages the ocean bottom to move the arm 78 upwardly in its guideway 90. The flooding port plate 94, which may be biased by springs 99, closes the bottom wall opening to prevent the entrance of mud, sand, clay or the like, which might impair the function of the cable. As the plunger arm 78 moves upwardly, the enlarged portion of the recess 88 aligns with flange 86 on the lower pin 66 first. The lower pin 66 disengages from the wall of respective recess 88 and the respective spring 96 now moves the pin axially of the shaft 56 and the pin to engage the pin in one of the spaced arcuate passageways 64 in the drum flange 62 and thereby couple the shaft 56 and the power springs 70 to the drum and place the cable 18 under spring tension. The other, or upper pin 66 disengages from the upper recess 88 slightly after the first or lower pin due to an elongate lip 98 on the wall of the respective recess 88 holding the flange 86 engaged for a shortly longer period during the movement of arm 78; however, as soon as the other or upper pin is released, it too moves into engagement with a respective passageway 64. The staggered release of the pins 66 ensures that at least one pin is engaged with the drum or reel 32 before the other pin disengages the springs 70 from arm 78 so that the springs 70 cannot freely unwind.

It will be noted that the straight line distance between the pins 66 is less than the straight line distance between opposite ends of two adjacent slots or passageways 64 in flange 62. Therefore, even if one pin 66 should engage the area of flange 62 between passageways 64 in the event of initial misalignment, the other pin will engage in an adjacent passageway 64 and any slight normal rotation of the drum will thereafter engage the other pin in its passageway 64. Additionally, a cam surface may be provided on the arm 78 adjacent the lower end of each passageway to move the respective pin into one of the passageways 64 if the pin should fail to move freely. With the pins 66 engaged in the passageways 64, the normal bias of springs 70 rotates the pins so that one pin engages against the end edge of its slot 64 at which time the buoy exerts a counteracting force to balance the spring tension and if the buoy is moved further from the anchor, the reel 32 rotates to rotate the pin 66 to in turn rotate shaft 56 to further tense the springs 70, which then exert a force for returning the buoy to its normal or average position relative the anchor. Thus the buoy is resiliently moved with the force stored in springs 70 applied in opposition to the ambient forces on the buoy.

The springs 70 are typically wound so that the buoy may move under ambient forces or normal conditions (such as a 2 knot current) within a watch circle of 0.25D when D is the water depth as for example, shown in FIG. 2. Thus, in a water depth of 30' to 180', a substantially constant tension of between 100 and 110 pounds is maintained on the cable 18 to permit buoy movement in a watch circle having a radius of substantially 21 feet. Normal conditions for the example described envision a tide range of 12 feet and a wave height of almost 9 feet with a current of two knots. The cable leading from the sheave 28 may move in an extremely wide angle since the sheave 28 can also rotate through a limited angle about the axis of the cable extending between the periphery of sheave 30 and the periphery of sheave 28 so that the buoy can move in the described watch circle, without fraying or binding of the cable. Greater excursions of the buoy are, of course, counteracted by the springs 70 with resilient restraint provided on the buoy up to what is known as a sea state 5 wave.

The foregoing constitutes a description of an improved apparatus for resiliently mooring a buoy to an anchor assembly and whose inventive concepts are believed set forth in the accompanying claims.

We claim:

1. For use in resiliently mooring a buoy deployed on a water surface with said buoy subject to ambient forces and having a cable extending between said buoy and an anchor as said anchor descends toward the water floor, the improvement comprising:

a drum with a portion of said cable wound on said drum, first means rotatably supporting said drum to enable said cable to unwind from drum in response to the descent of said anchor toward said floor, tensed resilient means having a force stored therein, second means operable for applying the force stored in said resilient means to said cable in opposition to said ambient forces, and third means carried by said anchor for engagement with said floor and automatically operated in response to said engagement to operate said operable second means for applying the force stored in said resilient means to said cable in opposition to ambient forces on said buoy, and in which said means rotatably supporting said drum include a shaft in said anchor rotatably supporting said drum in said anchor, and said resilient means comprises a power spring spirally wound about said shaft and having an inner radial end secured to said shaft and an outer radial end secured against movement relative said anchor whereby said spring is tensed in response to rotation of said shaft in one direction.

2. The improvement claimed in claim 1 in which said operable second means comprises pin means secured to said shaft against rotational movement relative said shaft and located at a position radially offset from said shaft and means for holding said pin means against rotation relative said anchor to hold said shaft against rotation.

3. The improvement claimed in claim 2 in which said pin means comprises one pin movable axially of said shaft and biased axially of said shaft in one axial direction, and said means for holding said pin means against rotation includes means for holding said one pin against movement in said one axial direction.

4. The improvement claimed in claim 3 in which said operable second means includes a radial wall secured to said drum and having a slot therein spaced radially of said shaft for receiving said pin in response to movement of said pin in said one axial direction.

5. The improvement claimed in claim 4 in which said anchor includes a bottom wall and said third means carried by said anchor for engagement with said floor includes an arm projecting from said bottom wall for movement transversely to said shaft axis in response to engagement with said floor for moving said means holding said pin against rotation and against movement in said one axial direction for enabling said one pin to move under said axial bias in said one axial direction for receipt in said one slot of said radial wall and for enabling rotation of said shaft with said drum.

6. In the improvement claimed in claim 5, a second pin secured to said shaft against rotational movement relative said shaft and biased axially of said shaft in said one axial direction, means for holding said second pin against rotation and against axial movement in said one direction and operated by said arm for enabling said second pin to move in said one axial direction subsequent to the movement of said one pin in said one axial direction, and a second slot in said radial wall for receiving said second pin.

7. In the improvement claimed in claim 6, a top wall for said anchor, a pair of tandemly arranged sheaves carried by said anchor with one of said sheaves located below said top wall for rotation about an axis parallel to said shaft and the other sheave being a fairlead sheave located above said top wall with said cable threaded around said sheaves between said drum and said buoy.

8. The improvement claimed in claim 5 in which said arm carries a plate for closing said bottom wall in response to engagement of said arm with said floor.

9. The improvement claimed in claim 8 in which said buoy has a bottom wall shaped in a prolate spheroid.

10. For use in resiliently mooring a buoy deployed on a water surface with said buoy subject to ambient forces and having a cable extending between said buoy and an anchor as said anchor descends toward the water floor, the improvement comprising:

a drum with a portion of said cable wound on said drum, first means rotatably supporting said drum in said anchor to enable said cable to unwind from said drum in response to the descent of said anchor toward said floor, a spring having a shaft rotatable in one direction for tensing said spring to store a force in said spring, second means secured to said shaft at a position spaced radially outwardly of said shaft for rotation with said shaft and movable axially of said shaft, spring means for biasing said second means in said one axial direction, a wall secured to said drum having a passageway spaced radially of said shaft at a position corresponding to said second means for receiving said second means in response to movement in said one axial direction of said second means, means movable transverse to said axis and engaged with said second means for holding said second means and said shaft against rotation to hold said force in said spring and hold said second means against movement in said one axial direction, and means carried beneath said anchor for engagement with said floor to move said transversely movable means transverse to said axis to disengage said second means for enabling movement of said second means in said one axial direction and receipt in said passageway and for thereafter enabling the rotation of said shaft with said drum to apply the force stored in said spring in opposition to said ambient forces.

11. The improvement claimed in claim 10 in which said transversely movable means comprises a plunger arm extending beneath said anchor and having a pair of recesses therein with each recess having a wall, and said second means comprises a pair of pins, each having an end flange received in a respective recess and each having a respective recess for receiving a respective plunger arm recess wall.

12. The improvement claimed in claim 11 in which the wall of one plunger arm recess disengages from the respective pin recess subsequent to the disengagement of the other plunger arm recess wall from the other pin recess.

13. For use in resiliently tethering a buoy deployed on a water surface to an anchor on the water floor and having a cable secured thereto, the improvement comprising an anchor, a drum in said anchor with said cable wound on said drum and extending to said buoy, a shaft in said anchor rotatably supporting said drum, a tensed spring wound in a spiral having an inner radial end secured to said shaft for rotation therewith and an outer radially end secured against movement relative said anchor, and means connecting said shaft to said drum for resiliently biasing said drum and cable against movement of said buoy in a direction extending said cable, and in which said means connecting said shaft to said drum comprises a radial wall secured to said drum and having a plurality of circumferentially spaced arcuate slots therein, a pair of pins secured to said shaft for rotational movement with said shaft and movable axially of said shaft in one direction for receipt in a respective one of said slots, and spring means for moving said pins axially of said shaft in said one direction to engage each pin a respective slot.

14. The improvement claimed in claim 13 in holding means engaged with said pins for holding said pins disengaged from said slots and against rotation to hold said shaft against rotation, and means extending beneath said anchor for engagement with said water floor in response to the movement of said anchor toward said floor for operating said holding means to disengage said holding means from said pins and enable said spring means to engage each pin in a respective slot.

15. The improvement claimed in claim 14 in which said holding means is operated to disengage from said pins in sequence whereby one pin holds said shaft against rotation until the other shaft engages a respective slot.

* * * * *